US006951496B2

(12) United States Patent
Koyama

(10) Patent No.: US 6,951,496 B2
(45) Date of Patent: Oct. 4, 2005

(54) METHOD OF MANUFACTURING AN IMAGE-FORMING APPARATUS COMPRISING A SUPPORTING FRAME WITH CORNERS HAVING A PREDETERMINED RADIUS OF CURVATURE

(75) Inventor: Shinya Koyama, Kanagawa-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 354 days.

(21) Appl. No.: 10/366,471

(22) Filed: Feb. 14, 2003

(65) Prior Publication Data

US 2003/0117064 A1 Jun. 26, 2003

Related U.S. Application Data

(62) Division of application No. 09/511,068, filed on Feb. 23, 2000, now Pat. No. 6,583,552.

(30) Foreign Application Priority Data

Mar. 2, 1999 (JP) ..... 11-054216
Feb. 14, 2000 (JP) ..... 2000-034488

(51) Int. Cl.[7] ..... H01J 9/00; H01J 9/24
(52) U.S. Cl. ..... 445/25; 445/24
(58) Field of Search ..... 445/24, 25; 313/495–497

(56) References Cited

U.S. PATENT DOCUMENTS 5,834,891 A 11/1998 Novich ..... 313/495
5,903,097 A 5/1999 Lee ..... 313/493
6,254,449 B1 7/2001 Nakanishi et al. ..... 445/25

FOREIGN PATENT DOCUMENTS

| | | |
|---|---|---|
| EP | 660 357 A1 | 6/1995 |
| EP | 701 265 A1 | 3/1996 |
| JP | 62-200636 | 9/1987 |
| JP | 62-252050 | 11/1987 |
| JP | 4-43538 | 2/1992 |
| JP | 5-74380 | 3/1993 |
| JP | 7-235255 | 9/1995 |
| JP | 8-264112 | 10/1996 |
| JP | 8-321254 | 12/1996 |
| JP | 11-25860 | 1/1999 |

*Primary Examiner*—Nimeshkumar D. Patel
*Assistant Examiner*—Mariceli Santiago
(74) *Attorney, Agent, or Firm*—Fitzpatrick, Cella, Harper & Scinto

(57) ABSTRACT

An image-forming apparatus with good yield and high reliability is provided by devising and improving the shape of a supporting member. Therefore, a flat type image-forming apparatus has at least a rear plate, a face plate arranged oppositely to the rear plate, and a supporting member arranged between the rear plate and the face plate and holding the distance between the rear plate and the face plate in an outer circumferential edge portion. In this flat type image-forming apparatus, the shape of a nook portion of the supporting member is set to an arc shape on the inner or outer side of a container.

21 Claims, 9 Drawing Sheets

METHOD OF MANUFACTURING AN IMAGE-FORMING APPARATUS COMPRISING A SUPPORTING FRAME WITH CORNERS HAVING A PREDETERMINED RADIUS OF CURVATURE

This application is a divisional of application Ser. No. 09/511,068, filed Feb. 23, 2000, now U.S. Pat. No. 6,583, 552, issued Jun. 24, 2003.

BACKGROUND OF THE INVENTION

1. Field of the Invention

The present invention relates to an image-forming apparatus.

2. Related Background Art

There are conventionally an image-forming apparatus using an electron-emitting device, a plasma display panel (hereinafter briefly called a PDP), etc. as an image-forming apparatus of a flat type. Two kinds of electron-emitting devices using a thermionic cathode and a cold cathode are known as the electron-emitting device. For example, the above image-forming apparatus is disclosed in Japanese Patent Application Laid-open Nos. 62-200636, 62-252050, 05-74380, 04-43538, 08-264112, 08-321254 and 11-25860, and U.S. Pat. No. 3,896,324, etc.

A field emission type (FE type), a metal/insulating layer/metal (MIM type), a surface conduction type, etc. begin to be practically used in the cold cathode.

In the image-forming apparatus using the electron-emitting device, the electron-emitting device and an image forming member are arranged within an airtight container. More concretely, electrons emitted from plural electron-emitting devices arranged on a rear plate are irradiated to a fluorescent substance (image forming member) on a face plate arranged oppositely to the rear plate so that an image is formed.

For example, when the above image-forming apparatus is used as a display, it is necessary to apply a high voltage of from several kV to several tens kV to the image forming member (fluorescent substance). Therefore, the above rear plate and the face plate are spaced from each other by a supporting member called an outer frame, etc. at a predetermined distance to secure a sufficient electric insulating property between the face plate and the rear plate. Joining portions of the above supporting member and the rear and face plates (outer circumferential portions of both the plates) are joined (airtightly sealed) to each other by a joining member so that the airtight container is formed. A pressure reducing state required to emit electrons is formed within the airtight container.

Here, one example of the structure and a manufacturing method of a conventional airtight container will be briefly explained on the basis of FIG. 7.

As shown in FIG. 7, an airtight container 710 is constructed by a rear plate 702, a face plate 701 and a supporting member 703. The supporting member 703 is formed by four structural members 703-1, 703-2, 703-3 and 703-4 formed in a plate shape (a rectangular parallelepiped).

The supporting member 703 is prepared by combining the above four structural members with each other in a frame shape and fixing these members to each other in advance by a bond such as low melting point glass.

A joining layer 704 such as low melting point glass is next formed in a joining portion of the rear plate 702 and the face plate 701. Thereafter, the supporting member 703 is nipped at a center and the rear plate 702 and the face plate 701 are aligned and stuck to each other. Further, while a load is applied to the rear and face plates, these plates are heated to a softening temperature of the joining layer 704 and are then cooled. Finally, the interior of the container is evacuated through an exhaust pipe (not shown) and a vacuum atmosphere or a gas atmosphere is formed within the container. Thereafter, the container is sealed by using a sealing method of the exhaust pipe, or an exhaust-pipeless method for forming the above atmosphere within a vacuum chamber and performing a seal attaching operation so that the airtight container 710 is completed.

SUMMARY OF THE INVENTION

The present invention has an object to provide an image-forming apparatus with good yield and high reliability by devising and improving the shape of a supporting member.

To achieve the above object, according to the present invention, there is provided an image-forming apparatus, characterized in that:

the image-forming apparatus includes an airtight container comprising:

a rear plate arranging plural electron-emitting devices therein;

a face plate arranged oppositely to the rear plate and having an image forming member; and a supporting member arranged between the rear plate and the face plate, for prescribing the distance between the face and rear plates, the interior of which being held in a pressure reducing state, and that:

the supporting member has four nook portions (four corners) and shapes of the four nook portions (four corners) have curvature on an inner or outer side of the container.

In addition, according to the present invention, there is provided an image-forming apparatus, characterized in that:

the image-forming apparatus includes an airtight container comprising:

a rear plate arranging plural electron-emitting devices therein;

a face plate arranged oppositely to the rear plate and having an image forming member; and a supporting member arranged between the rear plate and the face plate, for prescribing the distance between the face and rear plates, the interior of which being held in a pressure reducing state, and that:

the supporting member has four nook portions (four corners) and shapes of the four nook portions (four corners) have curvature on inner and outer sides of the container.

The electron-emitting device may be a cold cathode electron-emitting device and may be also a surface conduction electron-emitting device.

DETAILED DESCRIPTION OF THE PREFERRED EMBODIMENTS

Figure 7:
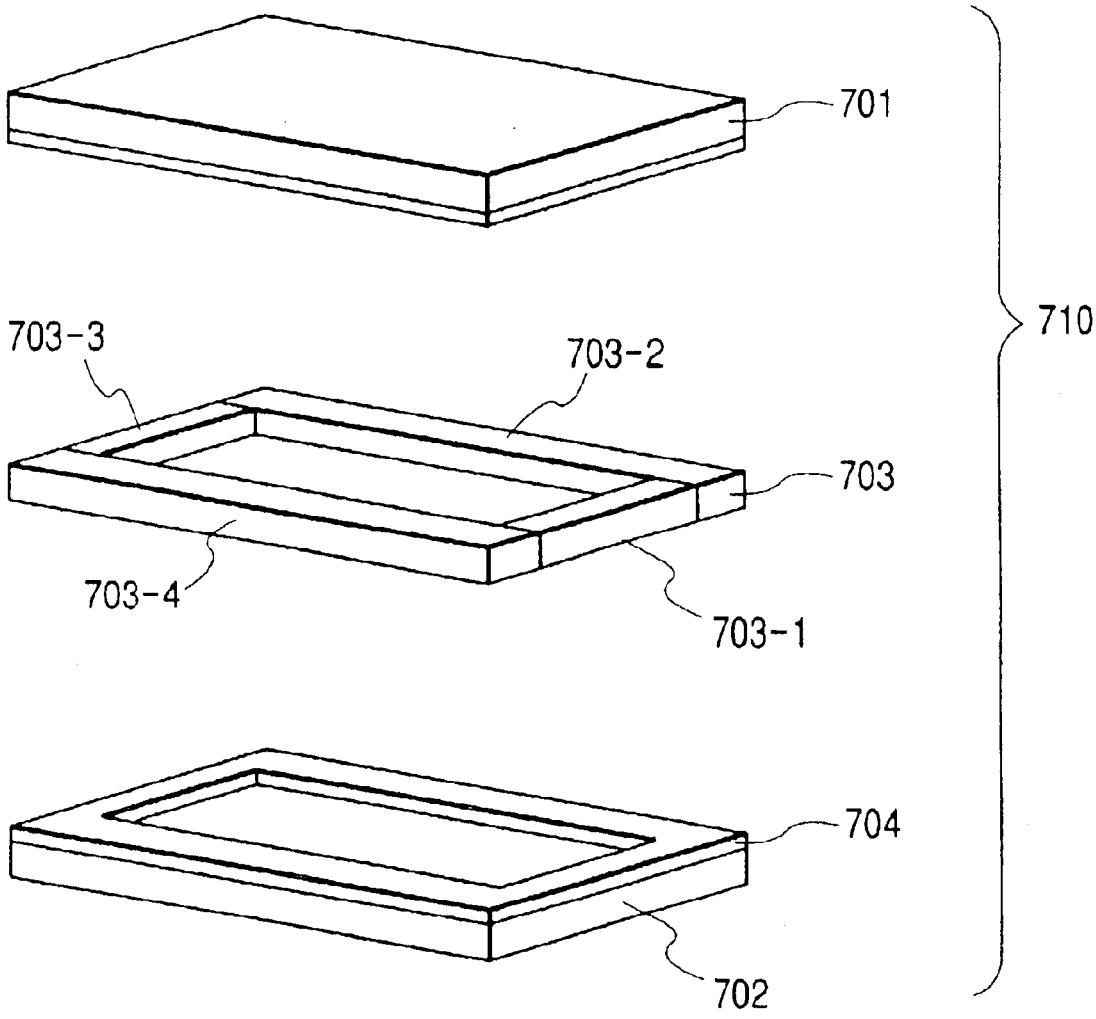
FIG. 7 is an exploded perspective view showing the schematic structure of a conventional flat type image-forming apparatus.

In the manufacturing method of the above-mentioned conventional image-forming apparatus, an adhesive property in the joining portions of the structural members easily becomes insufficient. Therefore, there is a case in which a slow leak (a very small vacuum leak) is caused in the container after the seal attachment. Further, since a pressure reducing state is set within the airtight container 710, stress concentration is easily caused in a corner (nook) portion of the supporting member when this nook portion (corner) is approximately formed in a perpendicular shape as shown in FIG. 7. Therefore, there is a case in which an adhesive is peeled off.

When the vacuum leak is caused, no electron is emitted from the electron-emitting device arranged within the airtight container so that it does not function as an image-forming apparatus.

As shown in FIG. 7, the above stress concentration in the corner portion is similarly caused in a case in which a glass plate is bored in a rectangular shape (frame shape) such that the nook portion (corner) is approximately formed in a rectangular shape as well as a case in which the plural structural members (703-1 to 703-4) are combined with each other. For these reasons, the stress concentration was one of factors of deterioration of yield of manufacture in the conventional structure of the image-forming apparatus. This phenomenon becomes notable as the image-forming apparatus is large-sized.

Stress is also concentrated onto the above nook portion (corner) in the integrated supporting member so that the supporting member is weakly formed in strength. Therefore, it is difficult to treat the supporting member and a manufacturing apparatus becomes complicated, etc. so that productivity is reduced.

One example of an embodiment mode of a flat type image-forming apparatus of the present invention will next be explained on the basis of the drawings.

The present invention can be particularly preferably applied to a flat type image-forming apparatus in which plural electron-emitting devices such as field emitters or surface conduction electron-emitting devices are arranged, and light is emitted from an image forming member such as a fluorescent substance so that an image is displayed. In particular, the present invention is preferably applied to an image-forming apparatus in which the distance between the above electron-emitting device and the image forming member (the distance between the face plate and the rear plate) is equal to or greater than 0.5 mm and is equal to or smaller than 10 mm, and is particularly equal to or greater than 1 mm and is equal to or smaller than 5 mm.

One example of the main structure of the image-forming apparatus of the present invention will be explained on the basis of FIG. 1.

Figure 1:
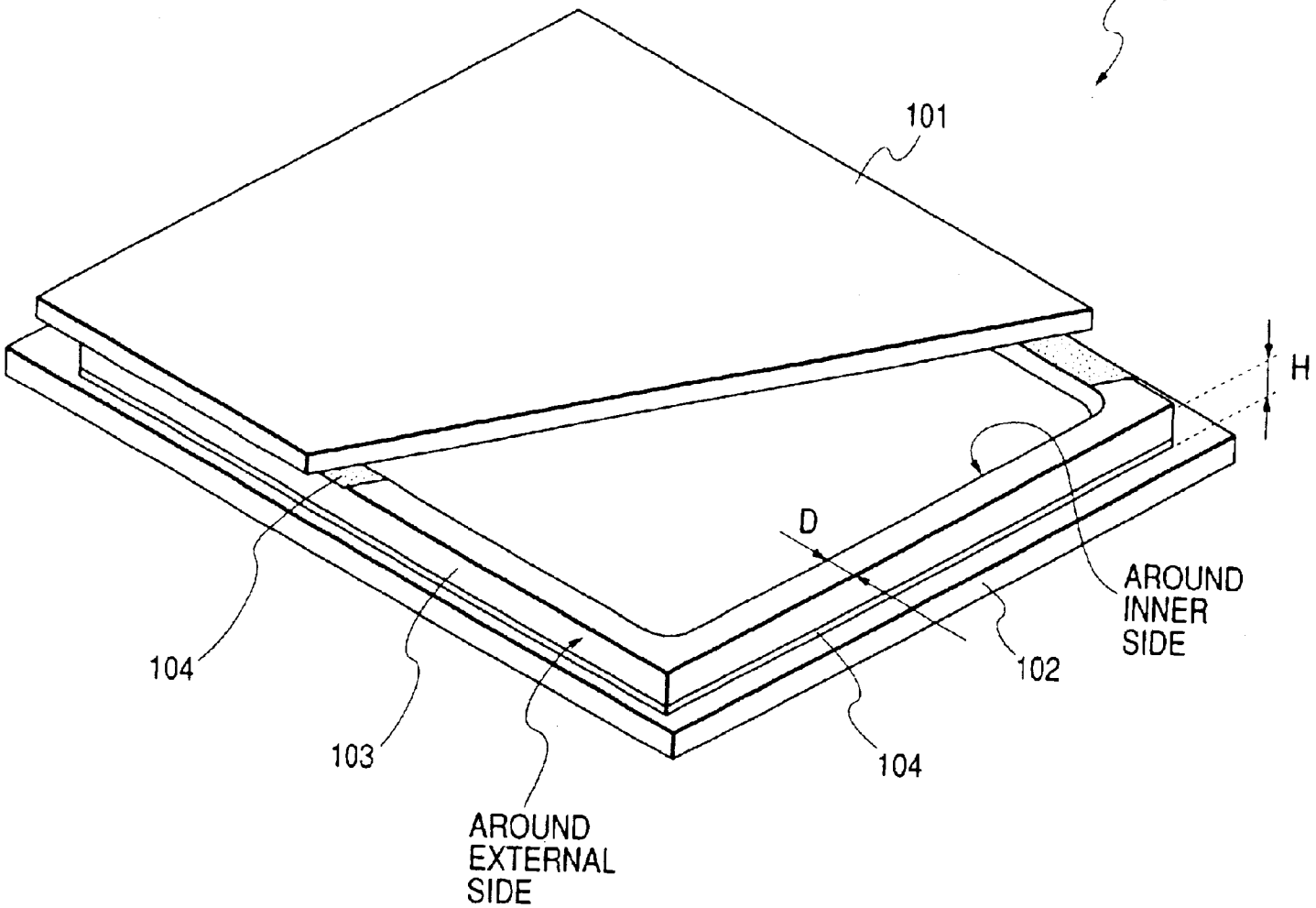
FIG. 1 is a perspective view showing the main structure of a flat type image-forming apparatus of the present invention.

FIG. 1 is a perspective view of the image-forming apparatus of the present invention and one portion of a panel is cut and illustrated to show an internal structure.

In FIG. 1, an image-forming apparatus (airtight container) 710 of the present invention is constructed by a first substrate 101 as a face plate, a second substrate 102 as a rear plate, a supporting member 103 disposed between the first and second substrates, and an adhesive 104 formed in a joining portion of each of these members. The interior of the airtight container 710 is held in a pressure reducing state, and is held in a vacuum degree equal to or higher than $10^{-6}$ Pa, preferably, a higher vacuum degree equal to or higher than $10^{-7}$ Pa.

The face plate 101 is constructed by a transparent member and is preferably made of glass. The face plate is substantially formed in a square shape.

In the image-forming apparatus using an electron-emitting device, a fluorescent substance emitting light by a collision with electrons, an anode electrode (metal back) for attracting an electron emitted from the electron-emitting device, etc. are arranged on the face plate. A high voltage is applied to the above anode electrode (conductive film). When a voltage applied to the device on the rear plate is set to a reference voltage (0 V), the voltage applied to the above anode electrode is equal to or higher than 1 kV and is equal to or lower than 20 kV, and is more preferably equal to or higher than 5 kV and equal to or lower than 20 kV, and is particularly preferably equal to or higher than 6 kV and equal to or lower than 15 kV in view of light emitting luminance of the fluorescent substance and a thickness of the supporting member described later, etc.

Wiring, etc. are arranged on the face plate in a plasma display panel (PDP).

The rear plate 102 is constructed by glass, etc. and is preferably formed by a material having a coefficient of thermal expansion equal to that of the face plate. Similar to the face plate, the rear plate is substantially formed in a square shape. Incidentally, plural electron-emitting devices are arranged on the rear plate. Therefore, an area of the rear plate is preferably larger than that of the face plate to take out wiring for operating the plural electron-emitting devices from the interior of the airtight container and connect the wiring to an external driver circuit.

In the image-forming apparatus using the electron-emitting devices, the electron-emitting devices are arranged on the rear plate. Each of the rear plate 102 and the face plate 101 has a major surface of an area larger than an area surrounded by an outer circumference of the supporting member 103.

In the PDP, a partition wall for limiting a plasma region, etc. are arranged on the rear plate and a fluorescent substance is further arranged in the PDP of a reflection type.

The supporting member 103 is preferably formed by a material having a coefficient of thermal expansion substantially equal to that of each of the face plate 101 and the rear plate 102.

In particular, a width D of the supporting member 103 of the present invention is preferably greater than its height (thickness) H. Thus, it is possible to particularly maintain strength of the supporting member and an airtight property of the airtight container in the image-forming apparatus in which the distance (the thickness H of the supporting member 103) between the face plate 101 and the rear plate 102 is a very thin thickness equal to or greater than 0.5 mm and equal to or smaller than 10 mm (particularly equal to or greater than 1 mm and equal to or smaller than 5 mm).

Figure 8A:
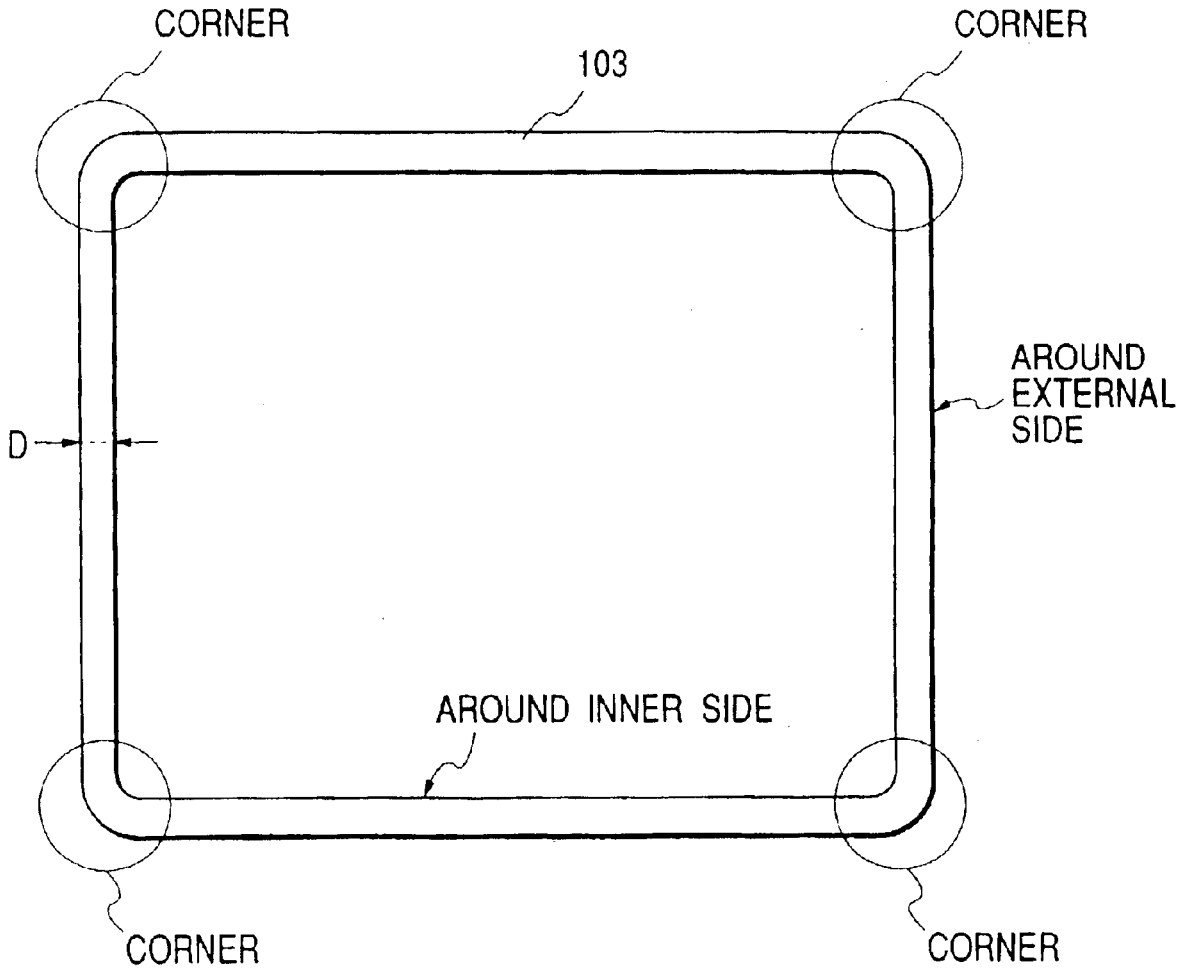
FIGS. 8A, 8B and 8C are typical plan views showing one example of a supporting member of the image-forming apparatus of the present invention.
Figure 8B:
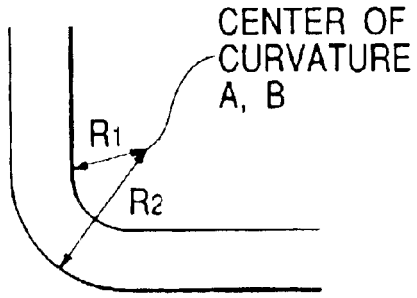
Figure 8C:
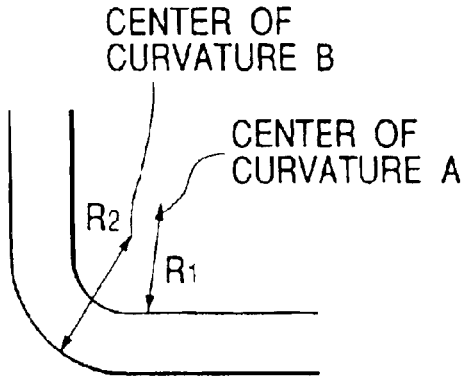

FIG. 8A is a typical plan view in which the supporting member 103 of the present invention shown in FIG. 1 is seen from a side of the face plate 101. It can be also said that FIG. 8A is a cross-sectional view showing that the supporting member 103 is cut on a plane substantially parallel to the main face of the face plate or the rear plate. However, FIGS. 8A to 8C show a case in which curvature is also provided in a nook portion (corner) of the supporting member on its outer circumferential side.

As shown in FIGS. 1 and 8A to 8C, outer and inner circumferences of the supporting member are preferably substantially formed in a rectangular shape. A ratio of long and short sides of the rectangular shape is 4:3 or 16:9 although this ratio depends on an aspect ratio of a display image.

Further, in the present invention, at least shapes of all four nook portions or corner portions located on an outer side (outer circumference) of the container are set to arc shapes (having curvature) in the supporting member 103 having the outer and inner circumferences substantially formed in a rectangular shape. Further, shapes of all four nook portions or corner portions located on an inner side (inner circumference) of the container are preferably set to arc shapes (having curvature). Further, in the present invention, it is most preferable to hold strength that the shapes of all the four nook or corner portions located on the outer side (outer circumference) of the container are set to arc shapes (having curvature), and the shapes of all the four nook or corner portions located on the inner side (inner circumference) of the container are set to arc shapes (having curvature) (see FIGS. 8A to 8C and 9A).

Figure 9A:
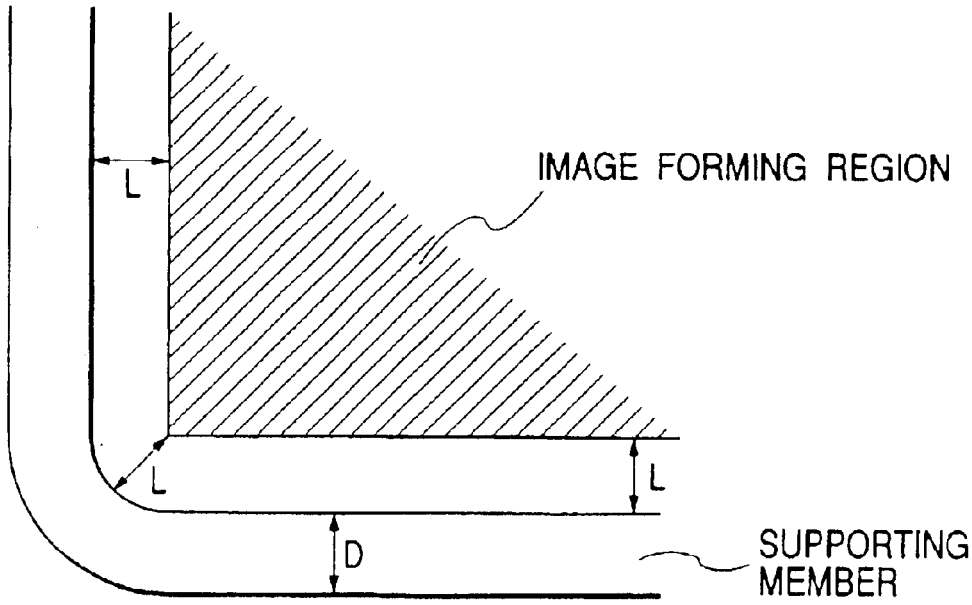
FIGS. 9A and 9B are typical plan views showing one example of the supporting member of the image-forming apparatus of the present invention.
Figure 9B:
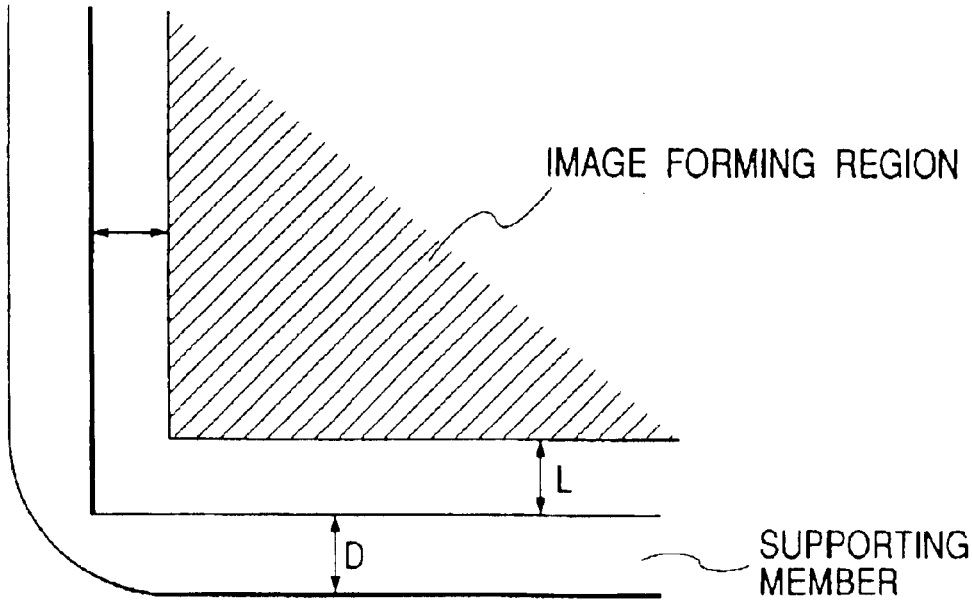

This is because the width D of the supporting member is narrowed in the nook portions when the shapes of the nook portions on the outer side of the container have curvature and the shapes of the nook portions located on the inner side of the container are perpendicular (see FIG. 9B).

The curvature of each of the nook portions on the inner side of the container is also required in view of stability of the orbit of an electron beam emitted from the electron-emitting device and stability of the image-forming apparatus, etc. as well as the strength of the airtight container as mentioned above.

Namely, as explained by using FIG. 9B, when the shapes of the nook portions located on the inner side of the container are perpendicular, the strength of the airtight container is reduced. Conversely, when the nook portions located on the inner side of the container conversely approach the side of an image forming region, these nook portions approach the electron-emitting device within the image forming region.

Therefore, an insulating material is generally used in the supporting member although it depends on the material of the supporting member. Accordingly, there is a case in which an electron emitted from the electron-emitting device or a scattering electron caused by scattering an electron irradiated to the anode electrode is irradiated onto surfaces of the above nook portions of the supporting member and notable charging is caused in these irradiated portions.

When such charging is caused, a high voltage of from several kV to several tens kV is applied to the anode electrode. Accordingly, there is a possibility that an electric discharge is caused between the anode electrode and the device (image forming region) on the rear plate.

Therefore, the distance L between the image forming region and the supporting member is preferably substantially an equal distance in view of restraining the electric discharge in the image-forming apparatus and sufficiently increasing a ratio of the image forming region to the entire image-forming apparatus.

Therefore, it is preferable in the present invention that the shapes of all the four nook or corner portions located on the-outer side (outer circumference) of the container are set to arc shapes (having curvature), and the shapes of all the four nook or corner portions located on the inner side (inner circumference) of the container are set to arc shapes (having curvature) (see FIGS. 8A to 8C and 9A, etc.).

Here, the "image forming region" in the present invention basically means a region for arranging the electron-emitting device, i.e., an inside region on a line connecting devices located at outermost ends, and a region on the face plate opposed to this inside region. However, since the electron beam is really widened, the image forming region also includes a region in which the widening of the electron beam emitting from each of the devices located at the outermost ends is considered. In other words, the "image forming region" means an inside region in connection of spots formed on the anode (face plate) by the beam emitted from each of the devices located at the outermost ends, and a region on the rear plate opposed to this inside region.

It is particularly preferable in strength of the airtight container that the width D of the supporting member in a corner portion is wider than the width D of each of portions (portions approximately formed in the shape of a straight line and located on four sides of a rectangular shape) corresponding to four sides. In other words, it is preferable in strength of the airtight container that the width of each of the nook portions is widest.

A curvature radius R2 (see FIGS. 8B and 8C) of each of the four nook or corner portions located on the outer side (outer circumference) of the container preferably ranges from 1 mm to 40 mm and further preferably ranges from 10 mm to 20 mm so as to particularly increase the strength. A curvature radius R1 (see FIGS. 8B and 8C) of each of the four nook or corner portions located on the inner side (inner circumference) of the container is equal to or smaller than the above value R2 and is preferably smaller than the value R2.

As shown in FIG. 8C, a curvature center A on the inner side (inner circumference) of the container and a curvature center B on the outer side (outer circumference) of the container may differ from each other.

The supporting member 103 in the present invention can be formed by boring processing, grinding processing, heating press processing, etc., but the present invention is not particularly limited to these processings.

The thickness (a length of the distance between the face and rear plates) H of the supporting member is equal to or greater than 0.5 mm and is equal to or smaller than 10 mm, and is more preferably equal to or greater than 1 mm and equal to or smaller than 5 mm in view of performance (luminance and stability of a display image) of the image-forming apparatus, accuracy, weight, handling, etc.

The adhesive 104 is constructed by an inorganic adhesive, an organic adhesive, etc., but is not particularly limited to these adhesives. However, it is necessary to satisfy conditions for the adhesive 104 that a vacuum airtight property is held and an emitted gas is reduced as much as possible and a heat resisting property for bearing heat processing (bake processing, etc.) in a subsequent process is provided and mechanical strength is sufficient after joining, etc. When the face plate, the rear plate and the supporting member are particularly formed by a glass material, the face plate, the rear plate and the supporting member are formed by using low melting point glass in many cases.

In the image-forming apparatus, the interior of the container is evacuated through an exhaust pipe (not shown) and a vacuum atmosphere or a gas atmosphere is formed within the container. Thereafter, the container is sealed by a sealing method of the exhaust pipe or an exhaust-pipeless method for forming the atmosphere within a vacuum chamber and performing a seal attaching operation so that the airtight container is completed.

Figure 2A:
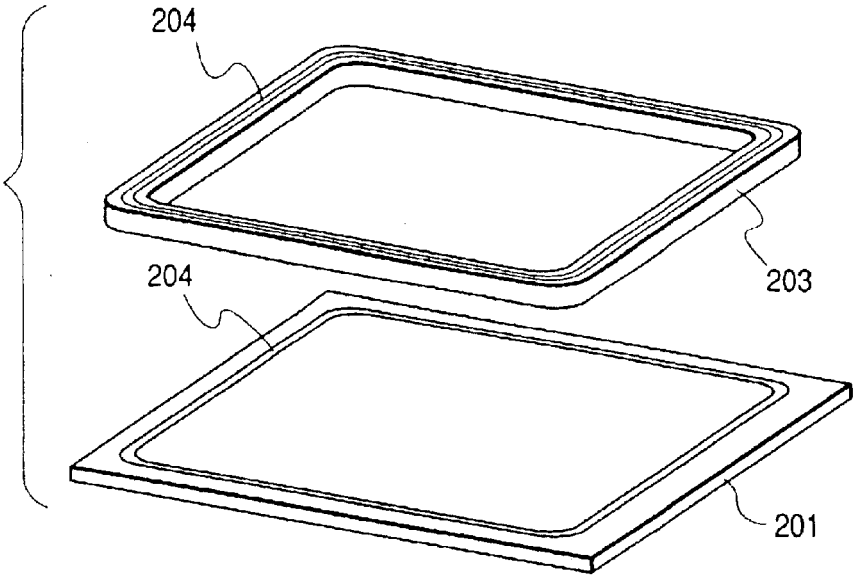
FIGS. 2A, 2B and 2C are schematic views showing a manufacturing method of the flat type image-forming apparatus of the present invention.
Figure 2B:
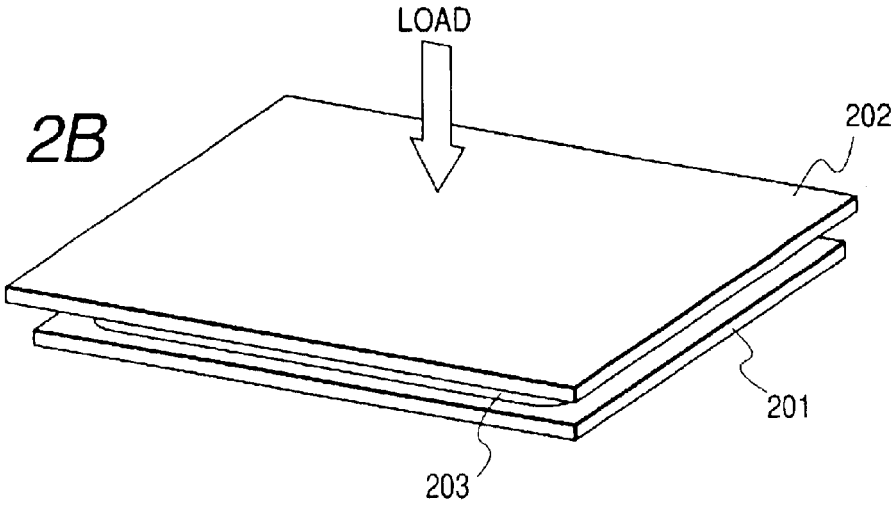
Figure 2C:
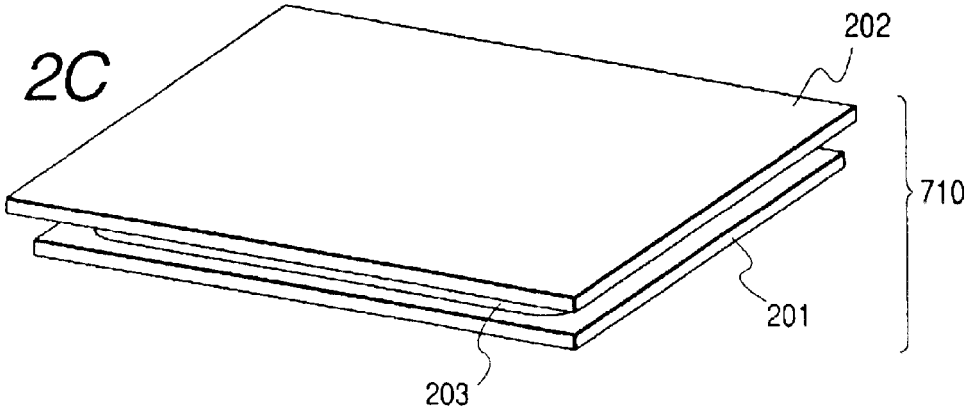

A manufacturing method of the image-forming apparatus of the present invention will next be explained on the basis of FIGS. 2A to 2C.

(1) An adhesive layer 204 is formed in seal attaching portions of a face plate 201 and a supporting member 203.

(2) The face plate 201 and a rear plate 202 are stuck to each other and are heated while positions of the face plate 201 and the rear plate 202 are aligned with each other through the supporting member 203. An adhesive is then fluidized and pressurized and held for a predetermined time.

(3) The face and rear plates are cooled and the pressurization is removed.

Thus, the container of the image-forming apparatus is manufactured.

The flat type image-forming apparatus of the present invention will next be explained further in detail by giving concrete embodiments.

<Embodiment 1>

An embodiment 1 of the present invention will be explained on the basis of FIGS. 2A to 2C.

In this embodiment, plural surface conduction electron-emitting devices constituting cold cathode electron-emitting devices are formed as electron-emitting devices in the rear plate 202, and a fluorescent substance is arranged in the face plate 201. A color image-forming apparatus is manufactured such that an effective display area has 30 inches in diagonal length and 3:4 in aspect ratio.

Figure 5:
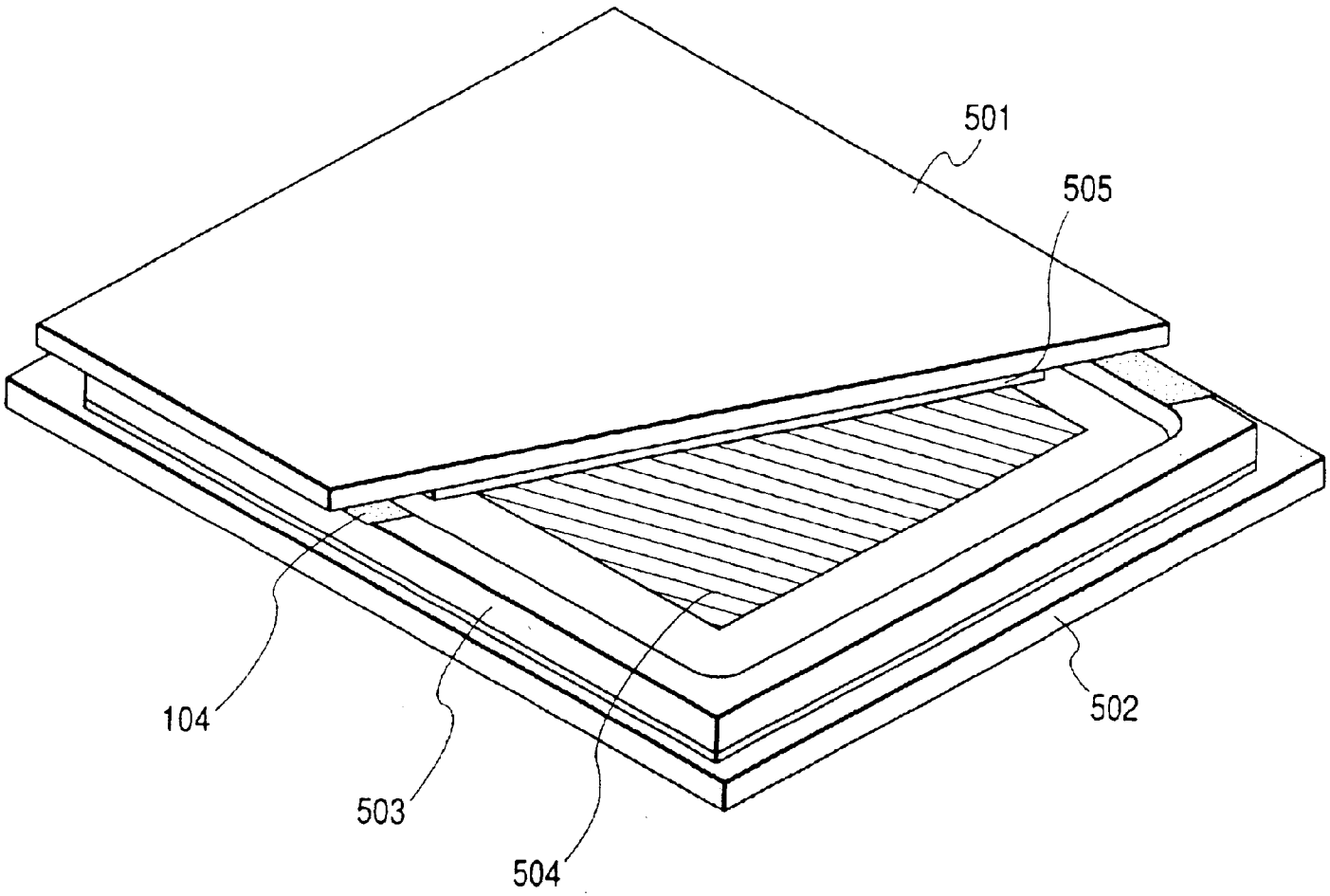
FIG. 5 is a perspective view of the flat type image-forming apparatus in the embodiment 1.

FIG. 5 is a perspective view of the image-forming apparatus used in this embodiment, and one portion of a panel is cut and illustrated to show an internal structure.

In FIG. 5, reference numerals 502, 503 and 501 respectively designate a rear plate, a supporting member and a face plate. An airtight container for maintaining the interior of the display panel in vacuum is formed by the face plate 501, the rear plate 502 and the supporting member 503. In FIG. 5, reference numerals 104, 504 and 505 respectively designate an adhesive, an electron-emitting device group (image forming region) and an image display portion (image forming region).

N×m surface conduction electron-emitting devices are formed on the rear plate 502 (n and m are positive integers equal to or greater than 2, and are suitably selected in accordance with the number of display pixels as objects. For example, in the image-forming apparatus with the display of a high grade television as an object, it is preferable to set n=3000 and m=a number equal to or greater than 1000. In this embodiment, n=100 and m=100 are set).

The above n×m surface conduction electron-emitting devices are wired in a simple matrix by m-row directional wirings (also called upper wirings in a certain case) and n-column directional wirings (also called lower wirings in a certain case).

Figure 3A:
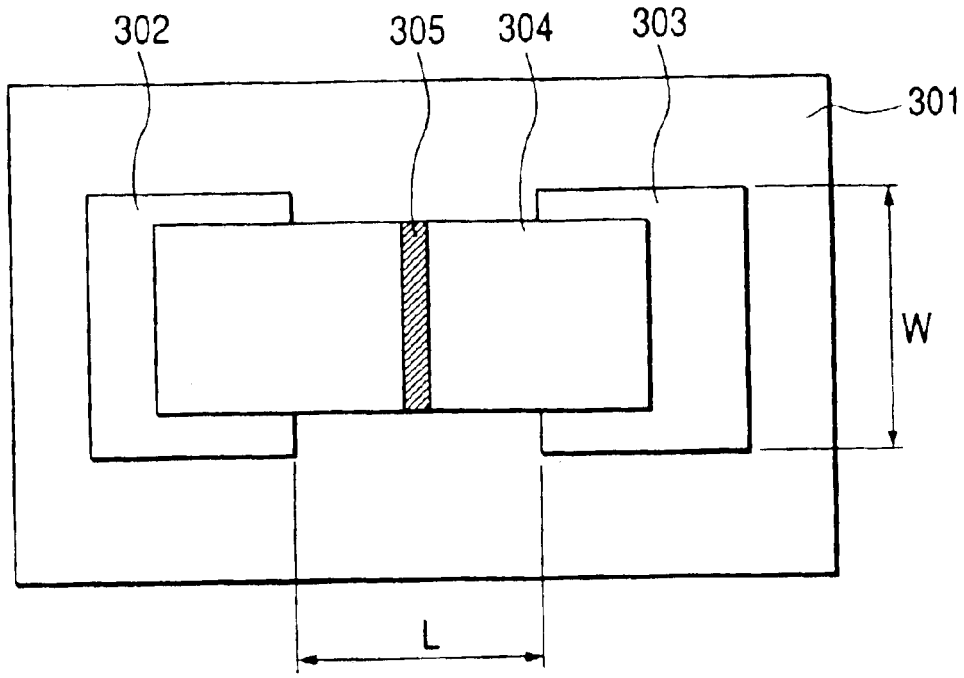
FIGS. 3A and 3B are typical views of a surface conduction electron-emitting device of a cold cathode used in an embodiment 1.
Figure 3B:
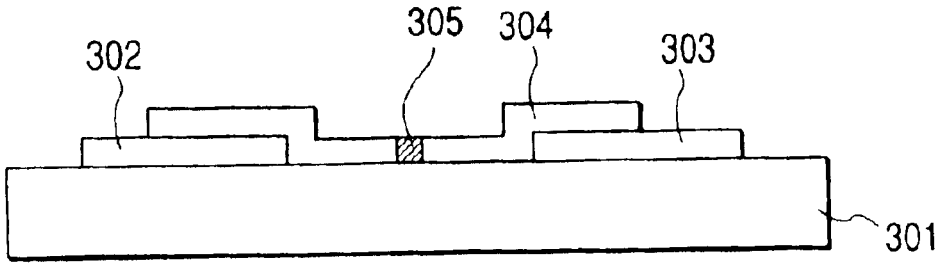

FIGS. 3A and 3B are typical views showing the structure of a surface conduction electron-emitting device to which the flat type image-forming apparatus of the present invention can be applied. FIGS. 3A and 3B are plan and cross-sectional views of the surface conduction electron-emitting device.

In FIGS. 3A and 3B, reference numeral 301 designates a substrate and reference numerals 302 and 303 designate device electrodes. Reference numerals 304 and 305 respectively designate a conductive film and an electron emitting portion.

The conductive film 304 is locally broken, deformed or deteriorated by performing "forming process" for the conductive film 304 through the device electrodes 302, 303 so that the electron emitting portion 305 is formed in an electrically high resistance state. Further, in an activating process for greatly improving an emitting electric current, a voltage is applied to the conductive film 304 of the surface conduction electron-emitting device and the electric current flows through the device so that an electron is emitted from the above electron emitting portion 305 (this technique is similar to that in Japanese Patent Application Laid-Open No. 7-235255 described in the prior art).

Figure 4A:
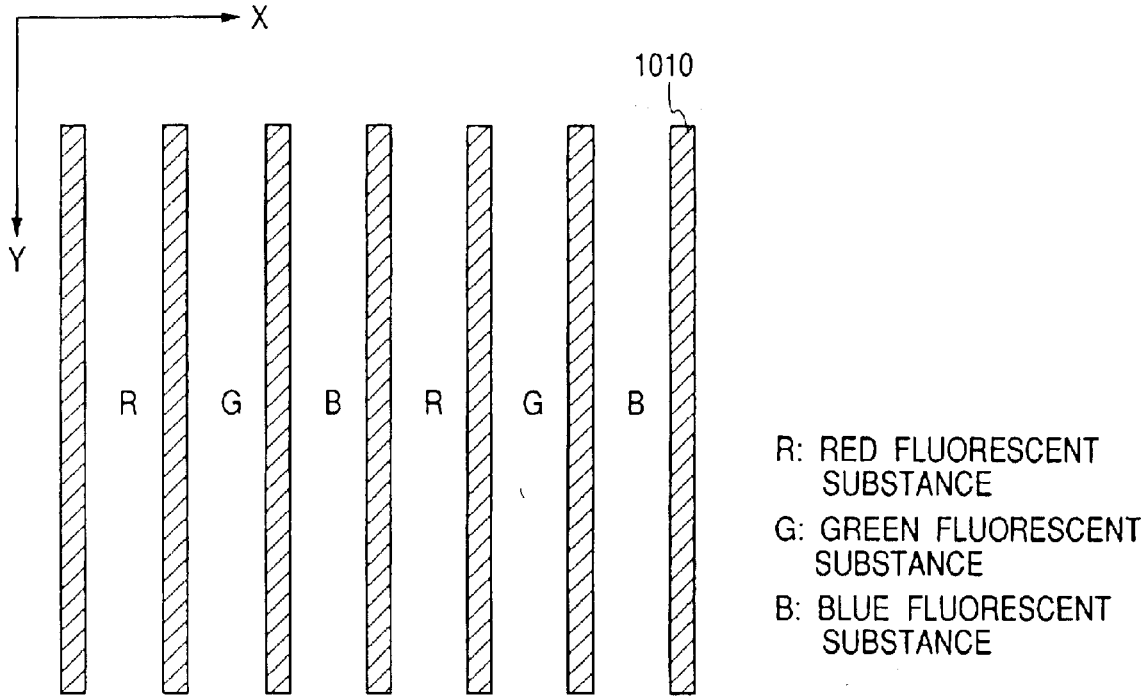
FIGS. 4A and 4B are typical views showing an example of a fluorescent film used in the embodiment 1.

An image display portion 505 constructed by a fluorescent film and a metal back is formed on a lower face of the face plate 501. Since a color display unit is formed in this embodiment, a portion of the fluorescent film is separately coated with fluorescent substances of the three primary colors of red, green and blue used in the field of a CRT. For example, as shown in FIG. 4A, the fluorescent substance of each color is separately coated in a stripe shape and a black electric conductor is arranged between stripes of the fluorescent substances. The black electric conductor is arranged for purposes of causing no shift in display color even when the irradiating position of an electron beam is slightly shifted, and preventing a reduction in display contrast by preventing reflection of external light, and preventing charge-up of the fluorescent film due to the electron beam, etc. The black electric conductor is constructed by using graphite as a main component, but may be also constructed by using a material except for graphite if this material is suitable for the above object.

Figure 4B:
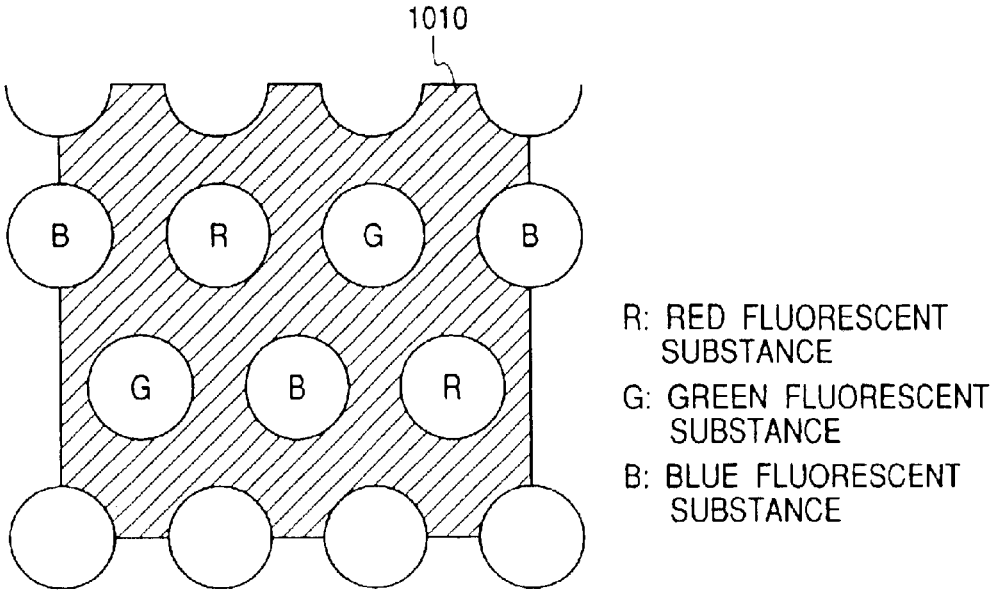

A separate coating method of the fluorescent substances of the three primary colors is not limited to an arrangement of the stripe shape shown in FIG. 4A, but may be also used in e.g., a delta-shaped arrangement as shown in FIG. 4B, and an arrangement except for this delta-shaped arrangement.

When a display panel of monochrome is made, it is sufficient to use a monochromatic fluorescent substance material in the fluorescent film and the black conductive material may not be necessarily used.

A well-known metal back in the field of the CRT is arranged on a face of the fluorescent film on a side of the rear plate 502. The metal back is arranged for purposes of improving light utilization efficiency by reflecting one portion of light emitted from the fluorescent film on a mirror face, and protecting the fluorescent film from the collision of negative ions, and acting as an electrode for applying an electron beam accelerating voltage, and acting as a conductive path of electrons excited from the fluorescent film, etc. No metal back is used when a fluorescent substance material for a low voltage is used in the fluorescent film.

For example, a transparent electrode using ITO as a material may be also arranged between the face plate substrate and the fluorescent film to apply the accelerating voltage and improve a conductive property of the fluorescent film although this transparent electrode is not used in this embodiment.

The above explanation has been made with respect to the basic structure of the embodiment 1 of the flat type image-forming apparatus applying the present invention thereto.

A manufacturing method of the embodiment 1 of the flat type image-forming apparatus of the present invention will next be explained sequentially.

Process-1 (Manufacture of Rear Plate)

A silicon oxide film is formed on a soda lime glass by a sputtering method. Thereafter, a device electrode is formed on the silicon oxide film. Next, a lower wiring, an upper wiring, an interlayer insulating layer and an upper wiring are sequentially formed by a screen printing method.

The lower and upper wirings are formed such that these wirings are connected to the device electrode. Next, a conductive film is formed by the sputtering method to thereafter pattern in a predetermined shape so that an electron-emitting device group (image forming region) 504 is formed.

Process-2 (Manufacture of Face Plate)

A fluorescent substance and a black electric conductor are formed on the soda lime glass substrate by a printing method. Further, smoothing processing (filming processing) on the surface of a fluorescent film on its inner face side is performed. Thereafter, Al (aluminum) is deposited by using vacuum evaporation, etc. so that a metal back is formed.

Further, a joining portion of a supporting member at a circumferential edge of the face plate 501 is coated with low melting point glass paste by a dispenser. This glass paste is dried to thereafter pretreat (calcinate) for ten minutes at 380° C. so that a low melting point glass layer is formed. In the low melting point glass, LS-3081 manufactured by Nippon Electric Glass Co., Ltd. is used as the paste.

Process-3 (Manufacture of Supporting Frame)

A supporting member 503 having 3.6 mm in thickness, 7 mm in width and 2±0.5 mm in curvature radius of a nook portion on its inner side is made by grinding the soda lime glass plate.

Further, a seal attaching face to the rear plate 502 is coated with low melting point glass paste by the dispenser. The low melting point glass paste is dried to thereafter pretreat (calcinate) for ten minutes at 380° C. so that a low melting point glass layer is formed.

Similar to the face plate 501, LS-3081 manufactured by Nippon Electric Glass Co., Ltd. is used as the paste in the low melting point glass.

Process-4 (Seal Attachment)

The face plate 501 and the rear plate 502 are overlapped with each other through the supporting member 503 and an entire container is uniformly heated while positions of the face plate 501 and the rear plate 502 are aligned with each other. Thus, an adhesive is fluidized and is pressurized and held for ten minutes at 410° C. so that a panel is sealed and attached.

Process-5

After the seal attachment, the face and rear plates are cooled and the pressurization is removed.

Process-6

An atmosphere within the container completed as mentioned above is exhausted by a vacuum pump through an exhaust pipe (not shown). After a sufficient vacuum degree is attained, a voltage is applied to an electron-emitting device through an external terminal (not shown) of the container and forming and activating processes are performed so that an electron-emitting portion is made.

Further, after a series of processes is terminated, baking is performed for ten hours at 250° C.

Process-7

The exhausting operation is next performed up to a vacuum degree of about $10^{-7}$ Pa at room temperature. The exhaust pipe (not shown) is melted and attached through heating by a gas burner so that an outer surrounding container is sealed. Finally, getter processing is performed by a high frequency heating method to maintain the vacuum degree after the seal.

In the image-forming apparatus of the present invention completed as mentioned above, a scanning signal and a modulating signal are applied by a signal generating means (not shown) to each electron-emitting device through the external terminal (not shown) of the container so that electrons are emitted from the electron-emitting device. A high voltage of 10 kV is then applied to the metal back or a transparent electrode (not shown) through a high voltage terminal (not shown). Thus, an electron beam is accelerated and collides with the fluorescent film and the fluorescent film is excited and emits light so that an image is displayed.

As a result, it is possible to reduce the generation of a slow leak in a nook portion of the supporting member and damage (peeling) of the container after the seal attachment. Thus, an image-forming apparatus with good yield and high reliability is obtained.

Further, since strength of the supporting member as a single body is improved, the supporting member is easily treated and productivity can be improved by simplifying the apparatus, etc.

<Embodiment 2>

In an embodiment 2 of the flat type image-forming apparatus of the present invention, a spacer is arranged as an atmospheric pressure resisting member to make the image-forming apparatus light in weight and nook portions of a supporting member at a circumferential edge are formed in an arc shape on both inner and outer sides.

In this embodiment 2, similar to the embodiment 1, plural surface conduction electron-emitting devices as cold cathode electron-emitting devices are formed as electron-emitting devices in a rear plate, and a fluorescent substance is arranged in a face plate. A color image-forming apparatus is manufactured such that an effective display area has 30 inches in diagonal length and 3:4 in aspect ratio.

The image-forming apparatus in this embodiment will first be explained on the basis of FIG. 6 and its manufacturing method will next be explained.

Figure 6:
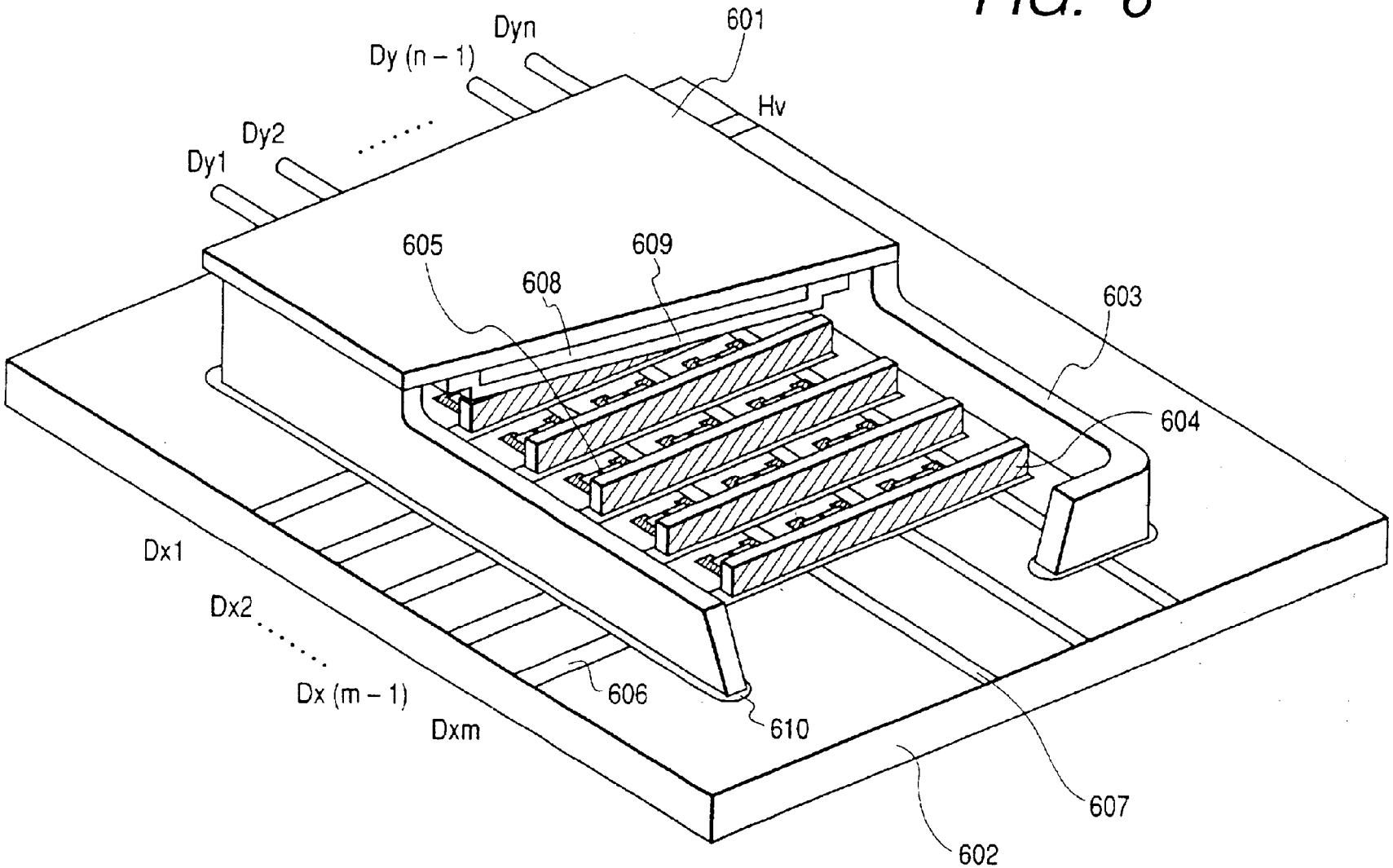
FIG. 6 is a perspective view of a flat type image-forming apparatus in an embodiment 2.

FIG. 6 is a perspective view of the image-forming apparatus used in the embodiment 2 and one portion of a panel is cut and illustrated to show an internal structure.

In FIG. 6, reference numerals 602, 604, 603 and 601 respectively designate a rear plate, a spacer as an atmospheric pressure resisting member, a supporting member and a face plate. An airtight container for maintaining the interior of the display panel in vacuum is formed by the face plate 601, the rear plate 602, the supporting member 603 and the spacer 604.

720×240 surface conduction electron-emitting devices are formed on the rear plate 602 and are wired in a simple matrix by 240 row directional wirings 606 (also called upper wirings in a certain case) and 720 column directional wirings 607 (also called lower wirings in a certain case).

A fluorescent film 608 is formed on a lower face of the face plate 601 by separately coating fluorescent substances of the three primary colors of red, green and blue. A metal back 609 is arranged in the fluorescent film 608 on a side of the rear plate 602.

Dx1 to Dxm, Dy1 to Dyn and Hv on the rear plate are pull-out wirings pulled out to the exterior of the container to electrically connect the display panel and an electric circuit (not shown). Dx1 to Dxm are electrically connected to the row directional wirings 606 of a multielectron beam source. Dy1 to Dyn are electrically connected to the column directional wirings 607 of the multielectron beam source. Hv is electrically connected to the metal back 609 of the face plate 601.

In FIG. 6, reference numerals 605 and 610 respectively designate an electron-emitting device portion and a low melting point glass layer.

The above explanation has been made with respect to the basic structure of the embodiment 2 of the flat type image-forming apparatus applying the present invention thereto.

Next, a manufacturing method of the embodiment 2 of the flat type image-forming apparatus of the present invention will be sequentially explained.

Process-1 (Manufacture of Rear Plate)

A silicon oxide film is formed on a soda lime glass by a sputtering method. Thereafter, a device electrode is formed on this silicon oxide film. Next, a lower wiring, an upper wiring, an interlayer insulating layer and an upper wiring are sequentially formed by a screen printing method. The lower and upper wirings are formed such that these wirings are connected to the device electrode.

Next, a liquid droplet of an aqueous solution of an organic metallic compound is given by an ink jet method. Thereafter, a substrate is baked at 350° C. and the organic metallic compound is thermally decomposed so that a conductive film of a metallic oxide is made. In this case, no patterning process of the conductive film given by the ink jet method is required.

Further, a prescribed portion on the upper wiring is coated with frit glass by a dispenser and the frit glass is pretreated (calcinated) for ten minutes at 380° C. after dried. Thus, a frit glass layer for fixing the spacer 604 is formed.

The frit glass is constructed by using conductive frit glass.

Process-2 (Manufacture of Face Plate 601)

A fluorescent substance and a black electric conductor are formed on the soda lime glass substrate by a printing method. Further, smoothing processing on the surface of a fluorescent film on its inner face side is performed. Thereafter, a metal back 609 is formed by depositing Al (aluminum) by using vacuum evaporation, etc.

Further, a joining portion of a supporting member at a circumferential edge of the face plate 601 is coated with low melting point glass paste by the dispenser. This glass paste is dried to thereafter pretreat (calcinate) for ten minutes at 380° C. so that a low melting point glass layer is formed. LS-3081 manufactured by Nippon Electric Glass Co., Ltd. is used as the paste in the low melting point glass.

Process-3 (Manufacture of Supporting Frame)

A supporting member 503 being 1.6 mm in thickness, 13 mm in width, 10±1.0 mm in curvature radius of a nook portion on its inner side, 18±1.0 mm in curvature radius of the nook portion on its outer side is made from a soda lime glass plate material by boring processing. Arc shapes of the nook portion on the inner and outer sides are set to have the same center.

Further, a seal attaching face to the rear plate 602 is coated with low melting point glass paste by the dispenser and is dried to pretreat (calcinate) for ten minutes at 380° C. so that a low melting point glass layer 610 is formed.

Similar to the face plate 601, LS-3081 manufactured by Nippon Electric Glass Co., Ltd. is used as the paste in the low melting point glass.

Process-4 (Attachment of Spacer)

The position of a spacer 605 is aligned with that of the low melting point glass layer 610 arranged on wiring of the rear plate 602. Then, the spacer 604 and the low melting point glass layer 610 are pressurized and heated so that the spacer 604 is joined to the low melting point glass layer 610. A joining temperature is set to 450° C. The spacer 604 is constructed by a flat spacer made of glass and being 200 $\mu$m in thickness and 1.8 mm in height. A film having high resistance, which is small in secondary electron emitting efficiency (using CrOx in this embodiment) is formed on a surface of the spacer 604.

Process-5 (Seal Attachment)

The face plate 601 and the rear plate 602 setting-up the spacer 604 therein in the process-4 are overlapped with each other through the supporting member 603. While positions of the face plate 601 and the rear plate 602 are aligned with each other, an entire container is uniformly heated and an adhesive is fluidized and the container is pressurized and held for ten minutes at 410° C. so that a panel is sealed and attached.

Process-6

After the panel is sealed and attached, the container is cooled and the pressurization is removed.

Process-7

An atmosphere within the container completed as mentioned above is exhausted by a vacuum pump through an exhaust pipe (not shown). After a sufficient vacuum degree is attained, a voltage is applied to an electron-emitting device through external terminals Dx1 to Dxm and Dy1 to Dyn of the container, and forming and activating processes of the conductive film are performed so that an electron-emitting device portion 605 is made. Further, after a series of processes is terminated, baking is performed for ten hours at 250° C.

Process-8

Next, the exhausting operation is performed at room temperature up to a vacuum degree of about $10^{-7}$ Pa, and the exhaust pipe (not shown) is melted and attached through heating by a gas burner so that an outer surrounding container is sealed. Finally, getter processing is performed by a high frequency heating method to maintain the vacuum degree after the seal.

In the image-forming apparatus of the present invention completed as mentioned above, a scanning signal and a modulating signal are respectively applied by a signal generating means (not shown) to each electron-emitting device through the external terminals Dx1 to Dxm and Dy1 to Dyn of the container so that electrons are emitted from the electron-emitting device. A high voltage equal to or higher than several kV is applied to the metal back or a transparent electrode (not shown) through a high voltage terminal Hv so that an electron beam is accelerated and collides with the fluorescent film. Thus, the fluorescent film is excited and emits light so that an image is displayed.

As a result, it is possible to reduce the generation of a slow leak in a nook portion of the supporting member and damage (peeling) of the container after the seal attachment. Thus, an image-forming apparatus with good yield and high reliability is obtained.

Further, since strength of the supporting member as a single body is improved, the supporting member is easily treated and productivity can be improved by simplifying the apparatus, etc.

In this embodiment, the spacer is fixed onto a side of the rear plate, but may be also attached onto a side of the face plate.

As explained above, in the flat type image-forming apparatus of the present invention, the shape of a nook portion of the supporting member arranged between the rear and face plates and holding the distance between the rear and face plates in an outer circumferential portion is set to an arc shape at least on an inner or outer side of the container.

Accordingly, the supporting member is easily molded in an integral type and it is possible to reduce the generation of a slow leak in a nook portion caused in the structure of a divisional supporting member and damage (peeling) of the container after the seal attachment. Thus, an image-forming apparatus with good yield and high reliability can be obtained.

Further, since strength of the supporting member itself is improved, the supporting member is easily treated and productivity can be improved by simplifying the apparatus, etc.

What is claimed is:

1. A method of manufacturing an image-forming apparatus comprising an airtight container, the method comprising the steps of:

(A) providing a face plate having an image forming member;

(B) providing a rear plate;

(C) providing a supporting frame which includes an external surface constituting part of an external surface of the container and having corners, at least one of which comprises an external surface with a radius of curvature R2;

(D) supplying a first adhesive to a sealing region between the face plate and the supporting frame;

(E) supplying a second adhesive to a sealing region between the rear plate and the supporting frame; and (F) connecting the face plate, the rear plate, and the supporting frame by heating the first and second adhesives, wherein the radius of curvature R2 is equal to or greater than 1 mm but not greater than 40 mm.

2. The method according to claim 1, wherein an internal surface of the supporting frame constitutes part of an internal surface of the container and has corners, at least one of which comprises an internal surface with a radius of curvature R1, and wherein the radius of curvature R1 is equal to or smaller than R2.

3. The method according to claim 1, further comprising a step of depressurising the space between the rear plate and the face plate to at least $10^{-6}$ Pa.

4. The method according to claim 1, further comprising a step of arranging a plurality of electron emitting devices on a surface of the rear plate.

5. The method according to claim 4, wherein the electron emitting device is a field emission type electron-emitting device.

6. The method according to claim 1, wherein the step (C) further comprises a step of boring a glass board to obtain a hollow structure.

7. The method according to claim 1, wherein a thickness of the supporting frame is equal to or greater than 0.5 mm and is equal to or smaller than 10 mm, in a direction where the face plate and the rear plate face each other.

8. The method according to claim 1, wherein the image-forming apparatus is a plasma display panel.

9. A method of manufacturing an image-forming apparatus including an airtight container comprising a face plate having an image forming member, a rear plate, and a supporting frame, the method comprising steps of;

forming a corner of the supporting frame to have a radius of curvature of equal to or greater than 1 mm but not greater than 40 mm; and supplying an adhesive between the face plate or the rear plate and the supporting frame, and then heating the adhesive so as to be hardened and to connect the face plate or the rear plate with the supporting frame.

10. The method according to claim 9, wherein the step of forming the corner of the supporting frame includes a process of grinding to form the radius of curvature at the corner of the supporting frame.

11. The method according to claim 9, wherein the step of forming the corner of the supporting frame includes a process of boring to form the radius of curvature at the corner of the supporting frame.

12. The method according to claim 9, wherein the step of forming the corner of the supporting frame includes a process of heating press to form the radius of curvature at the corner of the supporting frame.

13. A method of manufacturing an airtight container, the method comprising the steps of:

(A) providing a first plate and a second plate;

(B) providing a supporting frame which includes an external surface constituting part of an external surface of the airtight container and having corners, at least one of which comprises an external surface and has a radius of curvature R2;

(C) supplying a first adhesive to a sealing region between the first plate and the supporting frame;

(D) supplying a second adhesive to a sealing region between the second plate and the supporting frame; and (E) connecting the first plate, the second plate, and the supporting frame by heating the first and second adhesives, wherein the radius of curvature R2 is equal to or greater than 1 mm but not greater than 40 mm.

14. The method according to claim 13, wherein an internal surface of the supporting frame constitutes part of an internal surface of the airtight container and has corners, at least one of which comprises an internal surface with a radius of curvature R1, and wherein the radius of curvature R1 is equal to or smaller than R2.

15. The method according to claim 13, further comprising a step of depressurizing a space between the first plate and the second plate to at least $10^{-6}$ Pa.

16. The method according to claim 13, wherein the step (C) further comprises a step of boring a glass board to obtain a hollow structure.

17. The method according to any one of claims 13–16, wherein a thickness of the supporting frame is equal to or greater than 0.5 mm and is equal to or smaller than 10 mm, in a direction where the first plate and the second plate face each other.

18. A method of manufacturing an airtight container comprising a first plate, a second plate, and a supporting frame, the method comprising the steps of:

forming a corner of said supporting frame to have a radius of curvature equal to or greater than 1 mm but not greater than 40 mm; and supplying an adhesive between either said first plate or said second plate and said supporting frame, and then heating said adhesive to connect either said first plate or said second plate with said supporting frame.

19. The method of according to claim 18, wherein the step of forming the corner of said supporting frame includes a process of grinding to form the radius of curvature of the corner of said supporting frame.

20. The method of according to claim 18, wherein the step of forming the corner of said supporting frame includes a process of boring to form the radius of curvature of the corner of said supporting frame.

21. The method of according to claim 18, wherein the step of forming the corner of said supporting frame includes a process of heating press to form the radius of curvature of the corner of said supporting frame.

* * * * *

UNITED STATES PATENT AND TRADEMARK OFFICE

CERTIFICATE OF CORRECTION

PATENT NO. : 6,951,496 B2
DATED : October 4, 2005
INVENTOR(S) : Shinya Koyama

It is certified that error appears in the above-identified patent and that said Letters Patent is hereby corrected as shown below:

Title page,
Item [75], Inventor, "Shinya Koyama, Kanagawa-Ken (JP)" should read -- Shinya Koyama, Zama (JP) --.

Column 12,
Line 7, "spacer 605" should read -- spacer 604 --.

Column 13,
Line 55, "depressurising" should read -- depressurizing --.

Column 15,
Line 11, "of" should be deleted.

Column 16,
Lines 3 and 7, "of" should be deleted.

Signed and Sealed this

Fourteenth Day of March, 2006

JON W. DUDAS
*Director of the United States Patent and Trademark Office*